United States Patent [19]

Schaffhausen

[11] Patent Number: 4,844,827

[45] Date of Patent: Jul. 4, 1989

[54] LUBRICATING OIL ADDITIVE

[75] Inventor: John G. Schaffhausen, Naperville, Ill.

[73] Assignee: Amoco Corporation, Chicago, Ill.

[21] Appl. No.: 269,239

[22] Filed: Nov. 9, 1988

Related U.S. Application Data

[63] Continuation of Ser. No. 148,040, Jan. 25, 1988, abandoned.

[51] Int. Cl.[4] ..... C10M 133/00

[52] U.S. Cl. ..... 252/51.5 A; 252/51.5 R

[58] Field of Search ..... 252/51.5 A, 51.5 R

[56] References Cited

U.S. PATENT DOCUMENTS

| | | | |
|---|---|---|---|
| 3,368,972 | 2/1968 | Otto | 252/47.5 |
| 3,725,277 | 4/1973 | Worrel | 252/51.5 R |
| 3,798,247 | 3/1974 | Piasek et al. | 252/51.5 R |
| 3,803,039 | 4/1974 | Piasek et al. | 252/51.5 R |
| 4,425,245 | 1/1984 | Cahill et al. | 252/51.5 R |
| 4,717,492 | 1/1988 | Chibnik | 252/51.5 R |

*Primary Examiner*—Jacqueline V. Howard

*Attorney, Agent, or Firm*—Gunar J. Blumberg; William H. Magidson; Ralph C. Medhurst

[57] ABSTRACT

A highly dispersant lubricating oil additive having a relatively low nitrogen content is provided by reacting a solvent free bis(primary amine) composition with an aliphatic hydrocarbon-substituted succinimic anhydride or with an admixture of an aliphatic hydrocarbon-substituted phenol, formaldehyde, and a fatty acid.

5 Claims, No Drawings

LUBRICATING OIL ADDITIVE

This is a continuation of application Ser. No. 148,040, filed Jan. 25, 1988, now abandoned.

TECHNICAL FIELD

This invention relates to polyamine reaction products which provide lubricating oil additives having a low nitrogen content and which possess improved dispersant characteristics. The invention is especially concerned with such additives which can be produced using an inexpensive primary amine by-product.

BACKGROUND OF THE INVENTION

Modern gasoline and diesel engines develop damaging sludge and varnish deposits. These deposits are derived from fuel, oil, combustion by-products and entrapped water. The deposition problem is aggravated by high engine operating temperatures. Operating difficulties result when filters plug, valves stick, or when turbines become oil-starved. Ashless dispersants are commonly used to prevent sludge and varnish accumulations.

Ashless dispersants are, most commonly, reaction products of polyamines with either: (1) polybutylsuccinic anhydrides (to produce succinimides); or (2) polybutylphenol and formaldehyde (to produce Mannich bases, also termed Mannichs). These reactants or their reaction products are then reacted further with one or more acid, such as boric acid, or a fatty acid having 8–22 carbon atoms, such as oleic acid.

However, the polyamine reactants are costly and somewhat ineffective because low molecular weight polyamines, such as ethylene diamine, are disadvantageous, whereas higher molecular weight aliphatic polyamines frequently contain secondary nitrogen atoms which add to the nitrogen content while usually contributing relatively little to dispersancy.

Also, the secondary nitrogen atoms can remain unreacted and as such can contribute undesired basicity to the ashless dispersant. Excessive basicity tends to cause undesirable interactions with sulfonates and wear inhibitors. Fluoropolymer seals are degraded as well. By eliminating these secondary nitrogen atoms, this undesired basicity is reduced.

SUMMARY OF THE INVENTION

The present invention contemplates a highly dispersant lubricating oil additive which is a reaction product of a bis(primary amine) composition either with an aliphatic hydrocarbon-substituted succinic anhydride or with an admixture of an aliphatic hydrocarbon-substituted phenol, formaldehyde, and a fatty acid. The preferred bis(primary amine) composition comprises bis(p-aminocyclohexyl)methane, isomers thereof, as well as three- and four-ring analogs thereof. The contemplated di(primary amine) compositions are free from secondary amines.

DISCLOSURE OF PREFERRED EMBODIMENTS

In accordance with this invention, a highly dispersant lube oil additive having a low nitrogen content is obtained by reacting a solvent free bis(primary amine) composition containing bis(p-aminocyclohexyl)methane (PACM) in admixture with isomers thereof and analogs thereof containing three and four rings with either (1) an aliphatic hydrocarbon-substituted succinic anhydride or (2) an admixture of an aliphatic hydrocarbon-substituted phenol, formaldehyde and a fatty acid, such as oleic acid. This complex bis(primary amine) composition usually contains small amounts of methylene bis-aniline as well. These bis(primary amine) compositions are free from secondary amines and are available in solvent solution as PACM bottoms. Typically these compositions contain about 16–23% bis(p-aminocyclohexyl)methane, and in addition, about 1–5% methylene bis-aniline, about 4–13% of isomers of bis(p-aminocyclohexyl)methane, and about 48–62% of analogs of bis(p-aminocylcohexyl)methane containing three and four rings. These complex compositions are commercially available from Air Products Company as PACM bottoms.

In contrast with the presently contemplated use of PACM bottoms, in which all of the nitrogen atoms present are primary, polyamines used to manufacture the presently commercially available lube oil additives usually contain secondary nitrogen atoms as well as primary nitrogen atoms, as in tetraethylene pentamine.

Aliphatic hydrocarbon-substituted succinic anhydrides are known compounds. Preferred aliphatic hydrocarbon-substituted succinic anhydrides are those in which the aliphatic hydrocarbon group has a molecular weight of about 700–100,000. The aliphatic hydrocarbon group is preferably derived from an olefin polymer such as polypropylene, polybutene, ethylene-propylene copolymer, ethylene-propylene-1,4-hexadiene copolymer, ethylene-propylene-1,4-cyclohexadiene copolymer, ethylene-propylene-1,5-cyclotadiene copolymer, ethylene-propylene-5-methylene-2-norbornene, or ethylene-propylene-2,5-norbornadiene copolymer.

The most preferred aliphatic hydrocarbon substituent is derived from an olefin polymer having a molecular weight of about 700–5000. These include the olefin polymers mentioned above which have the more preferred molecular weight. Of the above, polybutene is most preferred. Optionally, a high molecular weight of olefin polymer, for example, one having a molecular weight of 100,000 or more, can be degraded to produce an olefin polymer having a more preferred molecular weight. Methods of reducing the carbon chain length of olein polymers by shearing are well known. Mere heating with mechanical stirring will reduce molecular weight. Air can be injected into heated polymer to cause degradation and reduce molecular weight. Extrusion through an orifice under pressure causes chain scission. Any combination of such methods can be used.

Highly preferred olefin polymers for use in making the succinic substituent are polymers of butene. Of these, the most preferred are the polybutenes having an average molecular weight of about 700–2000.

The hydrocarbon substituent can be introduced by heating a mixture containing the olefin polymer and maleic anhydride to about 200°–250° C. The reaction can be catalyzed by injecting chlorine. Likewise, a peroxide catalyst can be used. The reaction is preferably conducted in a mineral oil diluent which can remain in the succinic product to act as a solvent in later stages of the preparation.

Aliphatic hydrocarbon-substituted phenols suitable for the present purposes can be represented by the formula

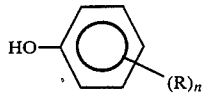

wherein R is an aliphatic hydrocarbon group containing up to about 500 carbon atoms and n is an integer having a value of 1 to 2. These compounds can be made by reacting an olefin having the proper molecular weight with phenol or a monoalkyl substituted phenol. The olefin contains about 50–500 carbon atoms which give a molecular weight of about 700–7000. The olefin reactant is preferably made by polymerizing a lower olefin such as ethylene, propylene, isobutylene, α-hexene, α-octene and mixtures thereof. Thus, useful olefin polymer reactants are polybutene, polypropylene, ethylene-propylene copolymer, and the like. Terpolymers can also be used to introduce the aliphatic hydrocarbon group. These include ethylene-propylene copolymers with dienes such as a 1,4-hexadiene, 1,5-hexadiene, 1,4-cyclotadiene, dicyclopentadiene, and the like.

The more preferred aliphatic hydrocarbon-substituted phenol reactant is polybutenyl phenol made by reacting a polybutene of 700–7000 molecular weight with phenol using a $BF_3$ catalyst such as $BF_3$ phenate or the like at a temperature of about 0°–60° C. Some more preferred reactants are those in which the polybutenyl group has a molecular weight of about 1000–3000.

Fatty acids useful in modifying the present Mannich-type dispersants include the aliphatic carboxylic acids containing 4 to about 30 carbon atoms. The more preferred fatty acids are those containing about 10–30 carbon atoms such as capric acid, undecylic acid, lauric acid, tridecoic acid, myristic acid, palmitic acid, linoleic acid, stearic acid, arachidic acid and the like. The preferred fatty acid is oleic acid. The use of such fatty acids in modifying Mannich dispersants is described in more detail in U.S. Pat. Nos. 3,798,247 and 3,803,039.

Boron compounds useful in modifying the Mannich dispersant are the same boron compounds used to boronate the succinimide dispersants. These are boron oxides, boron acids, esters of boron acids, salts of boron acids, boron halides, and mixtures thereof. The preferred boronating agent is boric acid. Use of such boronating agents in modifying Mannich dispersants is described in more detail in U.S. Pat. Nos. 3,751,365 and 3,756,953.

The succinimide-type dispersants are prepared by heat-reacting one mole of the bis(primary amine) composition with at least about one mole of the aliphatic hydrocarbon-substituted succinic anhydride. The imidation reaction is itself conventional. After imidation, the resulting succinimide or bis-succinimide can be borated by heat reacting with any source of boron, which may be boric acid.

Mannich base-type dispersants are prepared by heat reacting 1 equivalent of an alkylphenol with about 0.7 to about 1 equivalent of the bis(primary amine) composition (based on primary amine), with about 0.3 to about 1 equivalent of fatty acid (based on carboxyl), and with about 1.5 moles to about 2.2 moles of formaldehyde per equivalent of the phenol. It is convenient to add the formaldehyde in two stages and to use at least about 1 equivalent of formaldehyde in each stage. The Mannich-base type dispersants produced in the foregoing manner can be borated, if desired, using known techniques.

The lubricant additives produced in this invention are used in the preparation of ashless dispersants for inclusion in internal combustion engine lubricants, ashless dispersants containing Mannich bases or derivatives of succinimides, usually reacted with boric acid being themselves known.

The preparation of the ashless dispersant is carried out by blending the dispersant, e.g., the borated succinimide, in sufficient quantity to provide the desired nitrogen level in the final product, and sufficient diluent mineral oil to produce the desired concentration of the ashless dispersant in the final product. The temperature of blending is sufficiently high to render the viscosity of the mixture low enough for easy mixing. This generally requires a temperature in excess of about 38° C. and lower than about 260° C., preferably between about 93° C. and about 177° C. The blending is conducted under an inert atmosphere for a sufficient time to produce a uniform and compatible product, generally from two to twenty-four hours.

Throughout this application, all proportions, percentages, and the like, are by weight unless otherwise stated. The following examples describe the implementation of the various aspects of this invention.

EXAMPLE 1

One equivalent of polybutylphenol (H-1500 PBP), 0.92 equivalent of stripped (solvent-free) PACM bottoms, 0.3 equivalent of oleic acid and 2.0 equivalents of formaldehyde (added in two stages--about 1 equivalent in each stage) are reacted together. The PACM bottoms are provided in an amount of less than one equivalent to avoid free amine, but in an amount of more than 0.7 equivalent for good dispersancy. The oleic acid may be charged in an amount of up to about 1 equivalent, though below about 0.3 equivalent of oleic acid haze and resin are developed, which is undesirable. More than 2 equivalents of formaldehyde in each stage also result in haze formation. Substantial reduction of the amount of formaldehyde below 1 equivalent in either stage reduces performance.

The PBP, PACM bottoms (stripped of tetrahydrofuran), a base oil (a solvent-extracted mineral oil) and oleic acid are heated to 190° F. while sparging with nitrogen. The first formaldehyde charge is added slowly. After about 60 minutes the temperature is raised to 310° F. and the nitrogen flow rate is increased to strip out entrained water. After one hour, the nitrogen flow rate is reduced and the second formaldehyde charge is added at a rate such that foaming is controllable. After holding for about 60 minutes, the nitrogen flow is increased for one hour to remove water. Lastly, boration is carried out using a concentrated boron source, to produce a product containing 0.5% nitrogen and which displays IR absorptions at 1710 and 1610–1640 $cm^{-1}$. This product can optionally be filtered at the end of the reaction, if desired.

EXAMPLE 2

Following the procedure described in Example 1, a dispersant was prepared from 200g of H-1500 PBP (which is 48.9% active and has a molecular weight of 1600 [0.612 mole]), 11.8g of stripped PACM bottoms (provides 0.92 equivalent of amine), 13.9g of oleic acid (0.8 equivalent), 89.7g of base oil, 49g of formaldehyde solution in the first stage of (37.5% in water [1 equivalent]and 9.8g (2.0 equivalents) in the second stage. The product was clear without filtration.

EXAMPLE 3

Following the procedure described in Example 1, a dispersant was prepared from 200g of H-1500 PBP, 11.8g of stripped PACM bottoms, 7.0g of oleic acid, 89.7g of base oil, 4.9g of formaldehyde solution in the first stage, and 9.8g thereof in the second stage. The product was clear without filtration.

EXAMPLE 4

Following the same procedure, a dispersant was prepared from 200g of H-1500 PBP, 11.8g of stripped PACM bottoms, 7.0g of oleic acid, 76.5g of base oil, 4.9g of formaldehyde solution in the first stage, and 4.9g thereof in the second stage. The product was clear without filtration.

EXAMPLE 5

Following the same procedure, a dispersant was prepared from 200g of H-1500 PBP, 11.8g of stripped PACM bottoms, 3.5g of oleic acid, 74.0g of base oil, 4.9g of formaldehyde solution in the first stage, and 9.8g thereof in the second stage. The unfiltered product was clear, but contained some suspended solids which could be removed by filtration.

EXAMPLE 6

Following the same procedure, a dispersant was prepared from 200g of H-1500 PBP, 11.8g of stripped PACM bottoms, 3.5g of oleic acid, 71.2g of base oil, 4.9g of formaldehyde solution in the first stage, and 4.9g thereof in the second stage.

EXAMPLE 7

Following the same procedure, a dispersant was prepared from 200g of H-1500 PBP, 11.8g of stripped PACM bottoms, 5.2g of oleic acid, 76.6g of base oil, 4.9g of formaldehyde solution in the first stage, and 9.8g thereof in the second stage. The unfiltered product was slightly hazy.

EXAMPLE 8

Following the same procedure, a dispersant was prepared from 7500g of H-1500 PBP, 442.5g of stripped PACM bottoms, 195.0g of oleic acid, 2768g of base oil, 183.8g of formaldehyde solution in the first stage, and 183.8g thereof in the second stage. The finished product was bright and clear.

EXAMPLE 9

This Example illustrates the presently preferred stoichiometry, namely, 1:1 mole ratio of PACM bottoms to polybutenylsuccinic anhydride. A mixture of 6875g of H-1500 polybutenylsuccinic anhydride (58.4% active, 1.98 moles), 416.6g of stripped PACM bottoms (1.98 moles) and 3734.5g of base oil, were stirred at 340° F. under a nitrogen atmosphere for three hours. Water was lost during the reaction, but was not collected. The resulting succinimide can be borated in any desired fashion for incorporation into an ashless dispersant.

In this example, the product was diluted with 754.4g of a boron concentrate containing 3.27% boron and heated to 225° F. under nitrogen for one day. The product was filtered through a Whatman fiber filter with 535 Celite. The finished product was clear, exhibited a peak at 1700 $cm^{-1}$ in the infrared spectrum and contained 0.202% boron and 0.464% nitrogen. The yield was 10,239g.

EXAMPLE 10

The procedure of Example 9 was repeated using 500g of polybutenylsuccinic anhydride, 60.6g of stripped PACM bottoms, and 313.1g of base oil. Boration was omitted.

EXAMPLE 11

The procedure of Example 9 was repeated using 100g of polybutenylsuccinic anhydride, 7.3g of stripped PACM bottoms, and 56.2g of base oil.

EXAMPLE 12

The procedure of Example 9 was repeated using 100g of polybutenylsuccinic anhydride, 12.2g of stripped PACM bottoms, and 63.5g of base oil.

EXAMPLE 13

The procedure of Example 9 was repeated using 200g of polybutenylsuccinic anhydride, 11.0g of stripped PACM bottoms, and 106.9g of base oil.

EXAMPLE 14

The procedure of Example 9 was repeated using 200g of polybutenylsuccinic anhydride, 9.7g of stripped PACM bottoms, and 105.0g of base oil.

EXAMPLE 15

The procedure of Example 9 was repeated using 200g of polybutenylsuccinic anhydride, 8.5g of stripped PACM bottoms, and 103.2g of base oil.

EXAMPLE 16

The procedure of Example 9 was repeated using 200g of polybutenylsuccinic anhydride, 6.1g of stripped PACM bottoms, and 99.6g of base oil.

Spot Dispersancy Tests were carried out to determine the ability of the above products to disperse sludge. In these tests, the dispersant candidate is blended thoroughly into used engine oil and the blend is dropped onto filter paper. After the oil blend passes through the paper, the sludge ring and the oil ring are measured and the ratio of the sludge ring to the oil ring is expressed in percent. Higher percentages indicate higher dispersant capability.

On the above set forth basis, the percent dispersancy of the products of Examples 2–16 is tabulated in Table I, hereinbelow. These results are also compared with the performance of some standard lubricating additives under the same conditions.

TABLE I

| | % Dispersancy | |
|---|---|---|
| Dispersant Tested | 2% Treatment | 4% Treatment |
| Example 2 | 77% | 87% |
| Example 3 | 75% | 88% |
| Example 4 | 77% | 89% |
| Example 5 | 73% | 89% |
| Example 6 | 59% | 87% |
| Example 7 | 80% | 87% |
| Example 8 | 47% | 84% |
| Example 9 | 62% | 87% |
| Example 10 | 84% | 95% |
| Example 11 | 88% | 96% |
| Example 12 | 92% | 97% |
| Example 13 | 69% | 90% |
| Example 14 | 31% | 33% |

TABLE I-continued

| Dispersant Tested | % Dispersancy 2% Treatment | 4% Treatment |
|---|---|---|
| Example 15 | 37% | 85% |
| Example 16 | 34% | 33% |
| Commercial Mannich Dispersant A | 72% | 88% |
| Commercial Succinimide Dispersant | 34% | 65% |
| Commercial Mannich Dispersant B | 34% | 81% |

Even at the 4% level, the products of this invention perform better, in some instances much better than any of the commercial products. The products of this invention provide dispersancies of 75% and higher at the 2% treatment level. This is better than that of any of the commercial products that were compared therewith, and much better than some of them. Additionally, the present products have the advantage of being more economical to produce than any of the commercially available products.

The ability to prevent varnish deposits was assessed in the Varnish/Sludge Bench Test. In this test, the candidate dispersant is mixed at 0.25% to 1.00% with base oil. Nitrated diesel fuel was added at 2.0%. The resulting suspension was heated in a glass beaker (bottom of the beaker was not heated) at 150° C. for 16 hours. The supernatant oil was poured off and the beaker rinsed with hexane and dried. The resulting deposit weight was divided by the deposit weight in the absence of dispersant and the results of this calculation are expressed in percent in Table II, below. As will be evident, higher reported numbers indicate poorer performance.

TABLE II

| Dispersant Tested | % of Base Line 0.25% | 0.50% | 1.00% |
|---|---|---|---|
| Example 2 | 41% | 27% | 17% |
| Example 3 | 45% | 29% | 25% |
| Example 4 | 33% | 29% | 8% |
| Example 5 | 39% | 34% | 23% |
| Example 6 | 26% | 10% | 7% |
| Example 7 | 19% | 14% | 7% |
| Example 9 | 41% | 18% | 21% |
| Example 10 | 23% | 25% | 14% |
| Example 11 | 59% | 17% | 39% |
| Example 12 | 68% | 35% | 29% |
| Example 13 | 49% | 33% | 28% |
| Example 14 | 91% | 85% | 75% |
| Example 15 | 81% | 52% | 43% |
| Example 16 | 92% | | |
| Commercial Mannich Dispersant A | 21 | 9% | |

As can be seen, the additives tested all produced improvement over the control.

Inertness to fluroelastomer seals was measured by dispersant candidates at 7% in a fully formulated oil, which was then used to age Viton test samples for 10 days at 300° F.. The change in elongation of the test samples was measured. These measurements are compiled in Table III below. Values less than 25% are considered acceptable.

TABLE III

| Dispersant Tested | Average Change in Elongation |
|---|---|
| Example 13 | 17% |
| Example 14 | −20% |

TABLE III-continued

| Dispersant Tested | Average Change in Elongation |
|---|---|
| Example 15 | 10% |
| Example 16 | 12% |
| Commercial Mannich Dispersant A | 44% |
| Commercial Succinimide Dispersant | 25% |

The additive prepared in accordance with Example 8 was further evaluated in an engine test utilizing the following lubricating oil composition:

| Component | Parts by Weight |
|---|---|
| Product of Example 8 | 4.2 |
| Base Oil | 84.5 |
| Ethylene/Propylene VII | 7.0 |
| Pour Point Depressant | 0.2 |
| Wear Inhibitor | 1.05 |
| Oxidation Inhibitor | 1.0 |
| Anit-Friction Agent | 0.4 |
| Calcium Sulfonate | 0.75 |
| Magnesium Sulfonate | 0.9 |

The following results were obtained and are compiled in Table IV, below:

TABLE IV

| | Time of Run 240 h | 480 h | Passing Limit (480 h) |
|---|---|---|---|
| TGF | 30 | 36 | ≦45 |
| WLD | 20 | 36 | ≦140 |
| WCD | 52 | 60 | |
| WTD | 72 | 97 | |

The foregoing specification and the examples are intended as illustrative of the present invention and are not to be taken as limiting. Still other variations within the spirit and scope of this invention are possible and will readily present themselves to those skilled in this art.

I claim:

1. A dispersant lubricating oil additive having a relatively low nitrogen content which is the reaction product obtained upon reacting a bis primary amine composition free from secondary amines with an admixture comprising an aliphatic hydrocarbon-substituted phenol and formaldehyde at an equivalents ratio of amine:phenol:formaldehyde of about 0.7–1:1:1.5–2.2, where the bis primary amine composition comprises bis(p-aminocyclohexyl) methane, isomers thereof, and three- and four-ring analogs thereof.

2. The dispersant lubricating oil additive in accordance with claim 1 wherein said bis(primary amine) composition contains bis(p-aminocyclohexyl)methane in an amount of about 16 to about 23 percent by weight, methylene bis-aniline in an amount of about 1 to about 5 percent by weight, isomers of bis(p-aminocyclohexyl)methane in an amount of about 4 to about 13 percent by weight, and analogs of bis(p-aminocyclohexyl)methane containing three and four rings in an amount of about 48 to about 62 percent by weight.

3. The dispersant lubricating oil additive accordance with claim 1 wherein the aliphatic hydrocarbon-substituted phenol is polybutyl phenol.

4. The dispersant lubricating oil additive of claim 1 wherein said admixture of aliphatic hydrocarbon substituted phenol and formaldehyde further comprises a fatty acid.

5. A lubricating oil comprising the additive of claim 1.

* * * * *

UNITED STATES PATENT OFFICE
CERTIFICATE OF CORRECTION

Patent No. 4,844,827 Dated July 4, 1989

Inventor(s) John G. Schaffhausen

It is certified that error appears in the above-identified patent and that said Letters Patent is hereby corrected as shown below:

Column 2, Line 47 "olein" should be --olefin--

Signed and Sealed this

Third Day of July, 1990

*Attest:*

HARRY F. MANBECK, JR.

*Attesting Officer*

*Commissioner of Patents and Trademarks*